US009186721B2

(12) United States Patent
Bianchi et al.

(10) Patent No.: US 9,186,721 B2
(45) Date of Patent: Nov. 17, 2015

(54) DEVICE FOR SUPPORTING AND OSCILLATING CONTINUOUS CASTING MOULDS IN CONTINUOUS CASTING PLANTS

(71) Applicant: ARVEDI STEEL ENGINEERING S.P.A., Cremona CR (IT)

(72) Inventors: Andrea Teodoro Bianchi, Piadena (IT); Giovanni Arvedi, Cremona (IT)

(73) Assignee: ARVEDI STEEL ENGINEERING S.P.A, Cremona CR (IT)

( * ) Notice: Subject to any disclaimer, the term of this patent is extended or adjusted under 35 U.S.C. 154(b) by 0 days.

(21) Appl. No.: 14/364,457

(22) PCT Filed: Dec. 14, 2012

(86) PCT No.: PCT/IB2012/057338

§ 371 (c)(1),
(2) Date: Jun. 11, 2014

(87) PCT Pub. No.: WO2013/088408

PCT Pub. Date: Jun. 20, 2013

(65) Prior Publication Data

US 2014/0311699 A1 Oct. 23, 2014

(30) Foreign Application Priority Data

Dec. 16, 2011 (IT) ..... MI2011A2292

(51) Int. Cl.
*B22D 11/053* (2006.01)
*B22D 11/055* (2006.01)

(52) U.S. Cl.
CPC ..... *B22D 11/053* (2013.01); *B22D 11/055* (2013.01)

(58) Field of Classification Search
CPC ..... B22D 11/053; B22D 11/055
USPC ..... 164/416, 478, 443
See application file for complete search history.

(56) References Cited

U.S. PATENT DOCUMENTS 3,612,156 A * 10/1971 Schoffmann ..... 164/416
3,875,275 A * 4/1975 Lemelson ..... 264/45.3
(Continued)

FOREIGN PATENT DOCUMENTS

AT 408625 1/2002
CN 201644730 11/2010

OTHER PUBLICATIONS

International Search Report issued in counterpart PCT Application No. PCT/IB2012/057338.

(Continued)

*Primary Examiner* — Kevin P Kerns
(74) *Attorney, Agent, or Firm* — Lucas and Mercanti, LLP

(57) ABSTRACT

A device for supporting and oscillating continuous casting molds in continuous casting plants includes at least one support suitable to support a continuous casting mold, the support including a fixed assembly restrained to a frame of the device and a movable assembly that is slidably restrained to the fixed assembly in a vertical direction and connected to a servomechanism suitable to move it in a reciprocating manner relative to the fixed assembly along the axial direction, the movable assembly including a plurality of channels suitable to allow a flow of a cooling fluid to and from a cooling circuit of the mold, the channels being supplied by supply pipes arranged along the vertical direction. The device further includes at least one connecting pipe suitable to allow to connect a supply pipe, the connecting pipe having a T shape and including a first duct rigidly connected to the movable assembly in a horizontal direction, as well as a second and a third duct extending from the first duct in opposite ways along the vertical direction, the second and third ducts being respectively connected to first and second end portions of the fixed assembly through further axially deformable ducts and being respectively a blind duct and a flow-through duct suitable to allow the cooling fluid to flow towards the first and the second ducts. The second and third ducts, and preferably also the first duct, of the at least one connecting pipe have the same diameter of the supply pipes.

10 Claims, 3 Drawing Sheets

(56) References Cited

U.S. PATENT DOCUMENTS

| | | | | |
|---|---|---|---|---|
| 4,582,110 | A * | 4/1986 | Mizota | 164/504 |
| 6,158,496 | A | 12/2000 | Lonardi et al. | |
| 6,298,905 | B1 | 10/2001 | Kaell et al. | |
| 8,074,703 | B2 * | 12/2011 | Poloni et al. | 164/416 |

OTHER PUBLICATIONS

Written Opinion of International Searching Authority issued in counterpart PCT Application No. PCT/IB2012/057338.

* cited by examiner

DEVICE FOR SUPPORTING AND OSCILLATING CONTINUOUS CASTING MOULDS IN CONTINUOUS CASTING PLANTS

CROSS-REFERENCE TO RELATED APPLICATIONS

This application is a 371 of PCT/IB2012/057338 filed Dec. 14, 2012, which claims the benefit of Italian Patent Application No. MI2011A002292, filed Dec. 16, 2011, the contents of each of which are incorporated herein by reference.

FIELD OF THE INVENTION

The present invention generally relates to continuous casting plants and in particular to a device suitable to support a continuous casting mould and to allow its oscillation during a continuous casting process, with particular but not exclusive reference to the production of slabs.

BACKGROUND OF THE INVENTION

Continuous casting is an industrial manufacturing process wherein a metallic material in the liquid state, for example steel, is poured by gravity from a ladle into a tundish and from this into a continuous casting mould. As known, the mould of a continuous casting plant comprises an open bottom and side walls preferably but not exclusively made of copper, which, during operation of the plant, are constantly cooled preferably but not exclusively with water.

Thanks to the presence of a cooling system, the liquid metal which contacts the side walls of the mould is solidified thus forming a slab having a solidified "shell" around a "liquid core". The shell provides the slab with a degree of stability suitable to allow its descent through a plurality of rollers arranged downstream of the mould, which preferably but not exclusively define an arc-shaped path the radius of which is a few meters long, wherein the solidification process of the slab continues. Once reached an horizontal position, the slab can be cut to a specific size or machined e.g. by direct rolling without solution of continuity in order to obtain a series of finished products such as sheets and strips. The latter process is also known as "cast-rolling".

Plants for the manufacturing of slabs obtained by continuous casting are disclosed, for example, in the European patents EP 0415987, EP 0925132, EP 0946316 and EP 1011896 and in the international publication WO 2004/026497, all in the applicant's name, which relate in particular to the manufacturing of steel strips.

It is known that during a continuous casting process the mould is oscillated in a vertical direction, i.e. along the casting direction, in order to prevent solidified metal material from adhering to the copper side walls of the mould and to allow the supply of a lubricating medium that can reduce friction forces therebetween. The oscillation of the mould in the vertical direction preferably but not exclusively follows a sinusoidal law of motion.

For this purpose, the mould is generally mounted on a supporting and oscillating device comprising at least one support to which a servomechanism, such as a hydraulic jack, is connected so as to allow it to oscillate vertically. The support comprises in particular a fixed assembly restrained to a frame in turn mounted on a foundation, as well as a movable assembly slidably restrained to the fixed assembly along the vertical direction. The mould is mounted on the movable assembly, so that it can be moved vertically therewith. The movable assembly is connected to the servomechanism, therefore the total mass subjected to oscillatory movements includes the mass of the mould, the mass of the movable assembly of the support and the mass of the cooling fluid contained therein.

Preferably, but not exclusively, the supporting device comprises a pair of supports arranged symmetrically at the sides of the mould. In this case, the servomechanisms associated to the supports are properly coordinated with each other so as to generate on the supports of the mould oscillations of equal magnitude and phase.

The enormous technical and technological progress in the field of continuous casting plants allows to achieve a higher and higher "mass flows", i.e. to increase the amount of steel per unit time coming out from the continuous casting. This involves the use of more and more powerful cooling systems for the moulds, which require high working pressures of the cooling fluid, for example in the order of 20 bar or higher, and high flow rates, which result in supply pipes having larger and larger cross-sections.

The cooling fluid, for example water, is supplied to the mould through channels formed in the supports of the oscillating device, and in particular in the movable assembly of each support. These channels generally extend in a vertical direction, so as to allow the connection of the pipes that supply the cooling fluid below the movable assembly. During the circulation of the cooling fluid, the combined effect of high operating pressures and large cross-sections of the channels generates hydraulic forces having a magnitude comparable to that of other forces normally acting on the mould during the operation of a continuous casting plant, in particular inertia forces related to the mass of the mould and pulsating forces generated by the servomechanism that causes the mould to oscillate. The hydraulic forces generated by in- or outflows of the cooling fluid tend in particular to lift the mould and its supports, thus being involved in the dynamic balance together with the pulsating forces intended to oscillate them. Therefore, the servomechanism must be designed by taking into account this dynamic balance of the forces, which results in solutions the construction and operation of which are not always satisfactory.

Another problem of known supporting and oscillating devices for continuous casting moulds is that oscillations imposed by the servomechanism to the elastic elements that hydraulically connect fixed pipes, which are generally arranged vertically upstream of the supporting device of the mould, and the movable assembly of the single support, generate pressure fluctuations in the channels formed in the supports and in the cooling circuit of the mould, thus altering the flow rate of the cooling fluid over time and potentially causing pulsating vaporization phenomena. This reduces heat exchange between metal and mould and thus penalizes the solidification process of the slab. A reduced heat exchange can also result in the formation of cracks in the copper side walls of the mould in contact with the metal passing therethrough, as well as thermal fatigue phenomena.

In order to solve this problem it is known to use hydropneumatic accumulators arranged along the branches of the cooling circuit of the mould. However, the use of hydropneumatic accumulators is problematic, because of their overall dimensions. Furthermore, in order to effectively reduce pressure pulsations that disturb the flow of the cooling fluid, hydropneumatic accumulators must be designed for specific frequency ranges and set at defined pressure levels, thus not being able to properly operate when the pressure of the cooling fluid varies e.g. at the discharge of the mould in function of its flow rate.

SUMMARY OF THE INVENTION

There is thus a need to provide a device for supporting and oscillating continuous casting moulds in continuous casting plants that can overcome the drawbacks mentioned above, which is an object of the present invention.

An idea of solution underlying the present invention is to feed the cooling fluid in the channels formed in the movable assembly of each support horizontally, by connecting at least one of the supply pipes of the cooling fluid, which have a generally vertical orientation, by way of at least one T-shaped connecting pipe having a first horizontal duct connected to the movable assembly, a second blind vertical duct connected to the fixed assembly and a third vertical flow-through duct coaxial with the second duct and connected to the supply pipe. Thanks to this solution, a flow of cooling fluid supplied by a supply pipe enters into or exits from the movable assembly horizontally through the first duct and simultaneously flows vertically thus directing the vertical hydraulic forces, in particular hydrostatic forces, against the fixed assembly at the blind end of the second duct.

Therefore, it is possible to direct vertical hydraulic forces generated by the flow of the cooling fluid under pressure, i.e. forces directed towards the mould, on the fixed assembly of each support, thus leaving the mould free from the hydraulic forces which tend to lift it during operation of the continuous casting plant and allowing the servomechanism that makes the mould oscillate to operate under optimum conditions.

It is also an idea underlying the present invention to restrain to the supporting and oscillating device hydraulic dampers designed so as to minimize pressure fluctuations caused by the oscillation of the mould and its supports. In particular, these hydraulic dampers are mounted in line with the pipes supplying the cooling fluid and are arranged upstream or downstream of each support of the supporting and oscillating device, i.e. upstream or downstream of the cooling circuit of the mould, thus advantageously achieving a flow regime in the cooling circuit of the mould that is characterized by a quasi-static pressure condition suitable to maximize the heat exchange efficiency.

The hydraulic dampers may advantageously be associated with the T-shaped connecting pipes that supply the channels formed in the supports of the oscillating device and are therefore restrained to both the movable and the fixed assembly, thus allowing to combine in a synergistic way the configuration of the connecting pipes, intended to direct vertical hydraulic forces that would lift the mould towards the fixed assembly, with means suitable to dampen pressure fluctuations in the supply line of the cooling fluid.

This configuration is also simple and cheap and does not require complex modifications of the supports of a traditional supporting and oscillating device, nor of its restraints to a foundation, to the benefit of the plant costs.

BRIEF DESCRIPTION OF THE DRAWINGS

Further advantages and features of the supporting and oscillating device according to the present invention will become clear to those skilled in the art from the following detailed and non-limiting description of an embodiment thereof with reference to the accompanying drawings wherein.

DETAILED DESCRIPTION OF THE INVENTION

Figure 1:
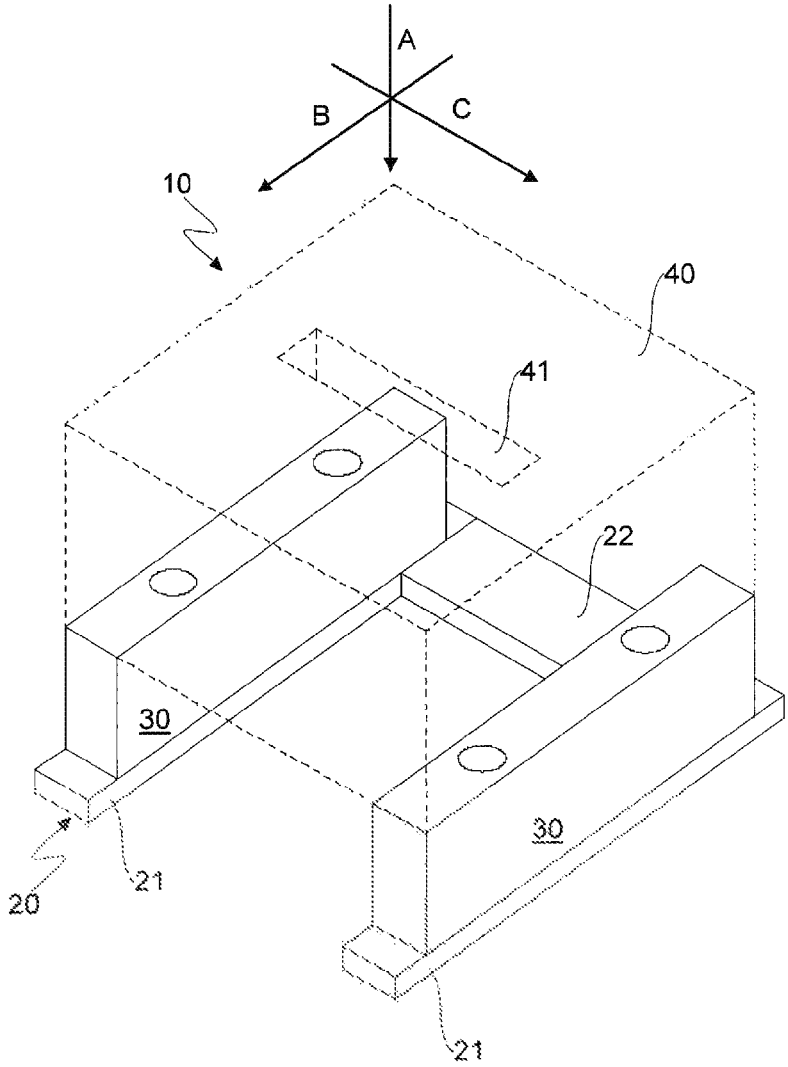
FIG. 1 is a perspective assembly view schematically showing a supporting and oscillating device for continuous casting moulds.
Figure 2:
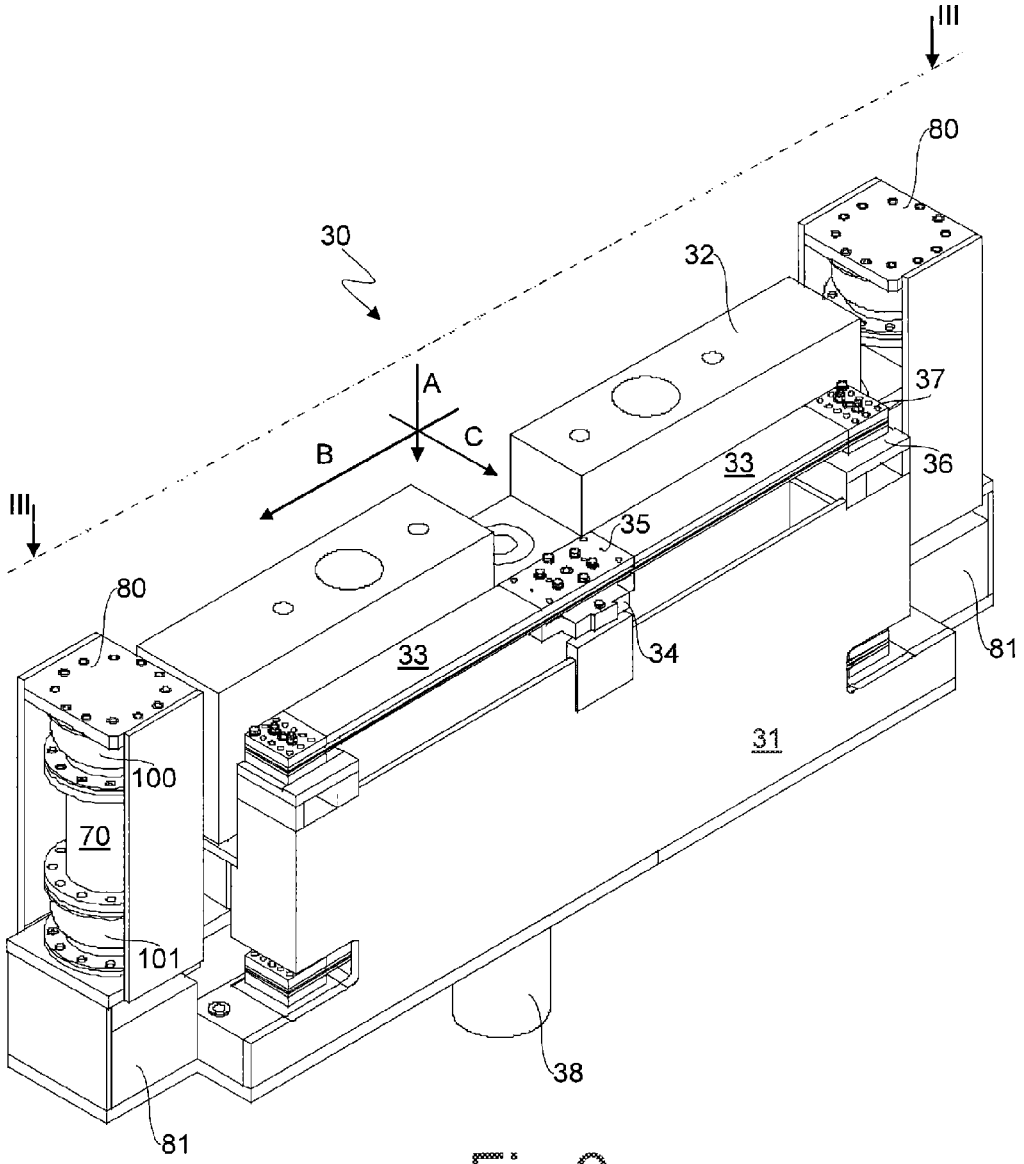
FIG. 2 is a perspective view showing a support of the supporting and oscillating device of FIG. 1.

Referring to FIGS. 1 and 2, a supporting and oscillating device for continuous casting moulds of continuous casting plants for slabs is indicated by the reference numeral 10 and comprises a frame 20 adapted to be fixed on a foundation (not shown) of a continuous casting plant. The frame 20 has a U-shape and comprises in particular two parallel arms 21 connected by a crosspiece 22.

The device 10 also comprises at least one support 30 suitable to support a continuous casting mould 40, which is schematically shown in FIG. 1 by a dashed line. In the illustrated embodiment, the device 10 comprises in particular a pair of supports 30 mounted on the parallel arms 21 of the frame 20.

During operation of a continuous casting plant, metal in the liquid state, for example steel, is poured by gravity into the mould 40 in a vertical direction A, preferably but not exclusively by means of a special ceramic duct (not shown), and crosses a flow-through cavity 41 of the mould 40 thus starting a cooling process which allows the formation of a "shell", i.e. a solidified outer surface of a slab. The flow-through cavity 41 has a substantially rectangular cross-section, the walls of which are typically but not exclusively made of copper.

The frame 20 is configured so that the parallel arms 21 with the supports 30 and the cross-member 22 surround the outlet opening of the flow-through cavity 41 without interfering with the passage of the slab. In particular, with reference to a generic plane perpendicular to the vertical direction A, the arms 21 and the supports 30 are aligned in a first horizontal direction B parallel to the shorter side of the cross-section of the flow-through cavity 41, whereas the crosspiece 22 is aligned in a second horizontal direction C parallel to the longer side of the cross-section of the flow-through cavity 41.

The mould 40 is provided with a cooling circuit (not shown) which surrounds the flow-through cavity 41 allowing to extract the thermal energy generated during the solidification process of the shell of the slab. The cooling circuit of the mould 40 is supplied by way of a plurality of channels formed in the supports 30, which open on the top planes of the supports 30, i.e. on the planes on which the mould 40 rests and is fixed, at points corresponding to the inlets and outlets of the channels of the cooling circuit.

As is known, during a continuous casting process the mould 40 is made to oscillate in the vertical direction A in order to avoid adhesion phenomena of the solidified metal on the copper walls of the flow-through cavity 41 and at the same time to reduce frictional forces therebetween.

Referring to FIG. 2, which shows only the left support 30 of the device 10 shown in FIG. 1, the supports 30 comprise a fixed assembly 31 restrained to the frame 20 and a movable assembly 32 slidably restrained to the fixed assembly 31 and connected to a servomechanism suitable to move it in a reciprocating manner, for example according to a sinusoidal law of motion. In the illustrated embodiment, the fixed assembly 31 surrounds the movable assembly 32 along its perimeter, so that the latter can slide relative thereto along the vertical direction A.

The mobile assembly 32 is also guided in the vertical direction A by a plurality of leaf springs 33 which, in the illustrated embodiment, are aligned in the first horizontal direction B and are restrained to the movable assembly 32 in a central position thereof and to the fixed assembly 31 at their ends. To this aim, the movable assembly 32 comprises flanges 34 on the sides arranged in the first horizontal direction B, which protrude therefrom in opposite directions in the second horizontal direction C and are respectively provided with counter-plates 35; the fixed assembly 31 includes supports 36 provided with respective counter-plates 37.

It will be understood that the restraining system described above is not essential in the invention, being known in the art several other restraining systems suitable to restrain the movable assembly 32 to the fixed assembly 31 which exploit e.g. rigid arms and hinges, guides, and the like. However, the above described restraining system, is advantageous because the use of leaf springs provides the movable assembly 32 with the characteristics of a vibrating system the natural frequency of which can be exploited to generate during the reciprocating movements resonance effects that can minimize the energy required to keep the mould 40 in motion.

Furthermore, the use of leaf springs 33 allows to reset the plays in the vertical movement direction A of the movable assembly 32, which instead characterize other restraining systems, such as those based on rigid arms with hinges and bearings.

As explained above, in order to allow the oscillation of the mould 40 the movable assembly 32 is connected to a servomechanism capable of imparting a reciprocating movement thereto, for example according to a sinusoidal law of motion.

Figure 3:
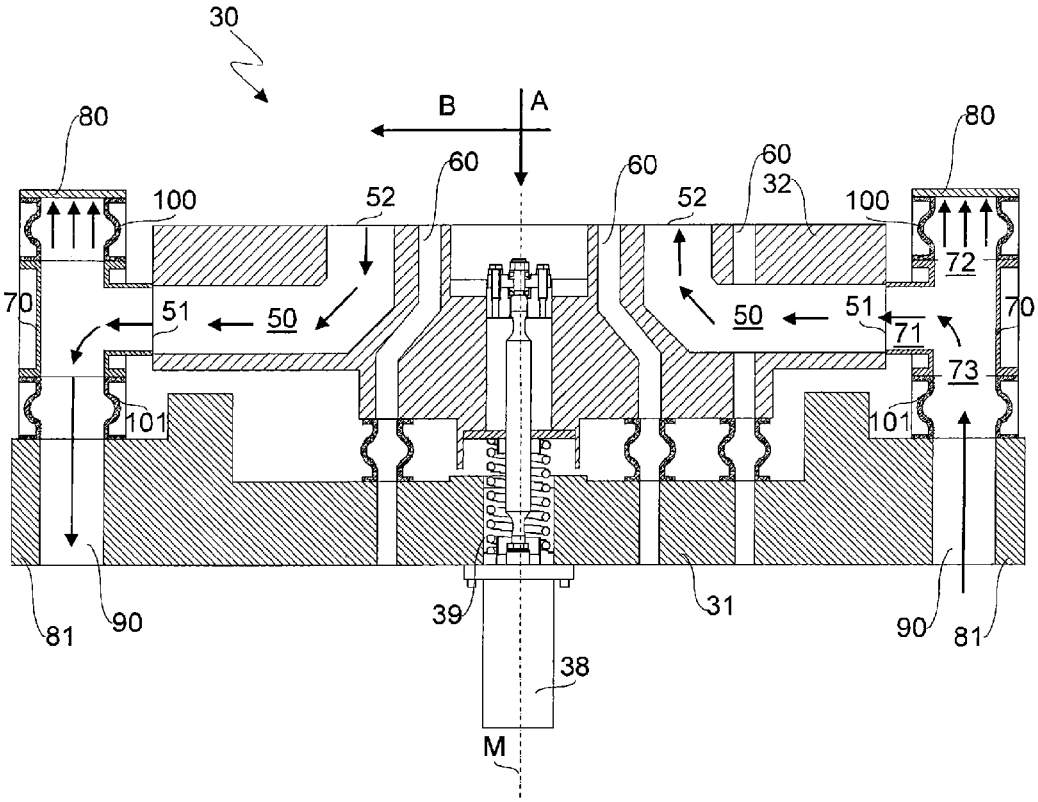
FIG. 3 is a longitudinal sectional view of the support taken along line III-III of FIG. 2.

Referring to FIG. 3, in the illustrated embodiment, the servomechanism includes in particular a linear actuator 38, for example an hydraulic actuator, that is connected at one end to the movable assembly 32 in a central position thereof along the first and second directions B and C, and to the fixed assembly 31 at the opposite end.

Coaxially to the linear actuator 38 a spring 39 is preferably arranged, for example a helical spiral, suitable to withstand the static load resulting from the weight of the mould 40, the movable assembly 32 and the cooling fluid contained therein. The use of a spring 39 is advantageous because it allows to use a linear actuator 38 of a smaller size and having a lower power on equal suspended total mass.

Still with reference to FIG. 3, in order to allow to supply the cooling circuit of the mould 40, the supports 30 comprise a plurality of channels 50, 60 adapted to allow passage of cooling fluid, for example water.

The supply pipes (not shown) of the cooling fluid are generally arranged upstream of the supporting device 10 with respect to the supply direction of the fluid are and connected to the fixed assemblies 31 of the supports 30. Moreover, the supply pipes are arranged in the vertical direction A, so that the path of the cooling fluid towards the mould 40 is substantially vertical.

In the illustrated embodiment the channels 50 and 60 have cross-section with a different surface area. The channels 50 have a larger cross-section and are intended to supply the cooling fluid to and from branches of the cooling circuit intended to cool the longer sides of the slab, while the channels 60 have a smaller cross-section and are intended both to supply cooling fluid to and from branches of the cooling circuit intended to cool the shorter sides of the slab and to cool the slab at the rollers that are arranged at the exit of the mould 40.

In the illustrated embodiment, the support 30 comprises two channels 50 of a larger diameter arranged symmetrically with respect to a median plane M of the mobile assembly 32 and three channels 60 of smaller diameter.

As shown in FIG. 3, the channels 50 of a larger diameter define a flow path comprising a right angle portion within the movable assembly 32 between a first aperture 51, for example defining an inlet for the cooling fluid, formed on the lateral surface of the movable assembly 32 and a second aperture 52 formed on its top surface, i.e. the surface intended to contact the mould 40. In the illustrated embodiment, the first apertures 51 of the channels 50 are formed on the sides arranged in the first horizontal direction B, thus not interfering with the leaf springs 33 which guide the movement of the movable assembly 32 in the vertical direction A.

The supports 30 also comprise at least one connecting pipe 70 adapted to allow the connection of at least one of the supply pipes of the cooling fluid to the channels formed in the movable assembly 32 and configured so as to allow entrance of the cooling fluid along an horizontal direction.

The at least one connecting pipe 70 is connected both to the movable assembly 32 of the support 30, as it happens in supporting and oscillating devices known in the art, and to the fixed assembly 31, and is configured such that a flow of cooling fluid under pressure enters and exits horizontally from the movable assembly 32 and urges the fixed assembly 31 in the vertical direction A at the same time.

As shown in FIG. 3, in the illustrated embodiment the connecting pipe 70 has a T-shape comprising a first duct 71 rigidly connected to the movable assembly 32 in correspondence with the first openings 51. The first duct 71 is arranged substantially horizontally and particularly in the first horizontal direction B. The connecting pipe 70 also comprises a second and a third ducts 72, 73 which extend in opposite directions from the first duct 71 along the vertical direction A.

Both the second and the third ducts 72, 73 are connected to the fixed assembly 31. In particular, the second duct 72 is connected to a first end portion 80 of the fixed assembly 31, while the third duct 73 is connected to a second end portion 81 which forms an extension of the base of the fixed assembly 31 in the first horizontal direction B. At the connection point of the third duct 73, in the second end portion 81 a channel 90 is formed, which allows passage of cooling fluid from a supply pipe (not shown) connected to the fixed assembly 31 towards the connecting pipe 70.

As it may be seen, by virtue of this restraining system the second duct 72 is a blind duct, whereas the third duct 73 is a flow-through duct adapted to allow passage of cooling fluid in the first and second ducts 71, 72.

In order to allow the oscillation of the movable assembly 32, the second and the third ducts 72, 73 of the connecting pipe 70 are not rigidly connected to the fixed assembly 31, but through a pair of axially deformable ducts arranged mutually opposite with respect to the first duct 71 of the connecting pipe 70.

In the illustrated embodiment, these axially deformable ducts are in particular sleeves 100, 101 having an Omega-shaped longitudinal section. The sleeves 100, 101 are made of an elastic material, such as fabric rubber, and dimensioned so as to withstand the supply pressure of the cooling fluid.

Considering for instance a flow of cooling fluid entering the cooling circuit of the mould 40, before entering the channels 50 formed in the movable assembly 32, the cooling fluid passes through the second end portion 81 of the fixed assembly 31 in correspondence of the channel 90 and subsequently through the third duct 73 in the vertical direction A, thus reaching the blind end of the second duct 72 connected to the fixed assembly 31 at the first end portion 80. The cooling fluid is simultaneously deviated at right angles into the first duct 71, thus entering the movable assembly 32 horizontally. Within the movable assembly 32, due to the geometry of the channels 50 the cooling fluid is deviated at a right angles and exits from the movable assembly 32 in the vertical direction A, then flowing directly into the cooling circuit of the mould 40, where it is deviated horizontally in order to cool the surfaces of the flow-through cavity 41.

The path of the cooling fluid to and from the mould 40 is schematically indicated in FIG. 3 by way of arrows that follow one another along the ducts of the connecting pipe 70. The parallel arrows shown in correspondence to the first end portion 80 represent instead the hydrostatic pressure of the cooling fluid.

In light of the above it will be understood that the hydraulic forces generated by the passage of cooling fluid under pressure through the connecting pipe 70, in particular through the third duct 73 and the second duct 72, and directed in the vertical direction A do not urge the mould 40 as it happens in the supporting and oscillating devices known in the art. On the contrary, these forces urge the fixed assembly 31 of each support 30, thus generating a corresponding reaction force in the foundation to which the device 10 according to the invention is assembled.

The second and the third ducts 72, 73 of the connecting pipe 70 and the channels 90, and preferably also the first duct 71, all have the same diameter, corresponding to the diameter of the supply pipes of the cooling fluid. This allows to avoid undesired dynamic effects such as acceleration or deceleration of the cooling fluid, which could generate additional stresses in the vertical direction A, and thus on the mould 40.

The flow of the cooling fluid under pressure which enters or exits horizontally passing through the first duct 71 of the connecting pipe 70 instead generates opposite forces directed horizontally, the resultant of which generates a corresponding reaction force in the leaf springs 33 and, more generally, in the restraining members between the fixed assembly 31 and the movable assembly 32, without affecting the balance of forces acting on the mould 40 in the vertical direction A.

Consequently, it is possible to optimize the operation of the linear actuator 38 and to design it solely as a function of the overall vibrating mass formed of the mould 40, the supports 30 and the cooling fluid, and regardless of the forces generated by the flow of the cooling fluid under pressure.

In the illustrated embodiment, the movable assembly 32 comprises in particular two T-shaped connecting pipes 70 arranged on opposite sides thereof in a horizontal direction symmetrically with respect to the median plane M, more precisely in the first horizontal direction B. A symmetrical configuration with respect to the median plane M of the connecting pipes 70 as that illustrated in FIG. 3 is advantageous, because it allows to minimize the resultant of the hydraulic forces directed horizontally.

Furthermore, in the illustrated embodiment the connecting pipes 70 are connected only to the conduits 50 of a larger diameter, also arranged symmetrically with respect to the median plane M. The channels 60 of a smaller diameter instead cross the movable assembly 32 in the vertical direction A, thus not allowing to minimize the hydraulic forces generated by the passage of the cooling fluid flowing therethrough when entering or leaving the mould 40.

In order to solve this problem, similarly to the channels 50 of a larger diameter, lateral inlets and outlets as well as connecting pipes arranged between the movable assembly 32 and the fixed assembly 31 may also be provided for the channels 60 of a smaller diameter with the advantages described above. However, the embodiment of the supporting and oscillating device 10 described above is advantageous because it is more compact than a supporting and oscillating which would result from the presence of additional connecting pipes with the channels 60 of a smaller diameter. Moreover, hydraulic forces that are generated by the passage of cooling fluid in the channels 60 of a smaller diameter are negligible compared to those present in the channels 50 of a larger diameter, and therefore substantially irrelevant in the balance of the forces acting on the mould 40.

According to a further aspect of the invention, the supporting and oscillating device 10 of the mould 40 comprises at least one hydraulic damper adapted to minimize the pressure fluctuations caused by the oscillation of the mould 40 and its supports 30. The at least one hydraulic damper is mounted in line with the pipes which supply the cooling fluid towards the supports 30 and is arranged upstream or downstream thereof with respect to the flow direction of the cooling fluid.

In particular, the at least one hydraulic damper is associated with the at least one connected pipe 70 mounted on the movable assemblies 32 of the supports 30.

According to the present invention, the hydraulic damper is advantageously formed by the axially deformable ducts associated with the at least one connection pipe 70, i.e., with reference to the illustrated embodiment, the elastic sleeves 100, 101 arranged opposite at the ends of the second and the third ducts 72, 73 of the connecting pipe 70 in the vertical direction A, which are in turn connected to the end portions 80, 81 of the fixed assembly 31.

The inventor has observed that the volume variations of the elastic sleeves 100, 101 due to the elasticity of the material of which they are made and caused by the reciprocating movements of the movable assembly 32 generates a cyclical pumping effect whose frequencies substantially correspond to the frequencies of the reciprocating movements imposed by the servomechanism, thus giving rise to pressure fluctuations in the path of the cooling fluid. By using pairs of sleeves that are arranged as shown in FIG. 3, when the movable assembly 32 is made to oscillate one sleeve is compressed while the other is subjected to traction. Consequently, pressure pulsations generated by the sleeves 100, 101 are added in phase opposition and will cancel each other, thus stabilizing the pressure of the cooling fluid.

Alternatively, the elastic sleeves 100, 101 may be replaced with other axially deformable elements such as, for example, telescopic ducts provided with appropriate sealing elements suitable to follow the oscillation movements of the movable assembly 32 while maintaining the connection between the connecting pipe 70 and the first and second end portions 80, 81 of the fixed assembly 31, these axially deformable elements being associated to a hydraulic damper as, for example, a hydropneumatic accumulator.

The configuration with opposite elastic sleeves 100, 101 is preferred because it ensures higher sealing characteristics with respect to the passage of the flow of cooling fluid and allows to achieve an effective damping action of pressure fluctuations while keeping to a minimum the overall dimensions of the supports 30, in addition to meeting criteria of cost effectiveness and ease of maintenance.

The use of hydropneumatic accumulators can instead be advantageously combined with the use of hydraulic dampers in the form of opposite elastic sleeves in order to obtain a more complete damping action of pressure oscillations in the path of the cooling fluid. In this case, in fact, since hydraulic dampers allow to dampen almost all the pressure fluctuations due to the oscillatory movements of the mould, hydropneumatic accumulators of a small size may be employed and calibrated at pressure well-defined and limited ranges, for example corresponding to the possible variations in the supply pressure of the cooling fluid.

According to a further embodiment of the invention, the supporting and oscillating device 10 comprises at least one hydropneumatic accumulator e.g. arranged along one of the channels formed in the movable assembly 32 of each support 30 of the mould 40, for example along one of the channels 50 of a larger diameter.

The invention claimed is:

1. A device for supporting and oscillating continuous casting moulds in continuous casting plants, said device comprising at least one support suitable to support a continuous casting mould said support comprising a fixed assembly restrained to a frame of the device and a movable assembly that is slidably restrained to said fixed assembly in a vertical direction (A) and connected to a servomechanism suitable to move it in a reciprocating manner relative to the fixed assembly along said vertical direction (A), said movable assembly comprising a plurality of channels suitable to allow a flow of a cooling fluid to and from a cooling circuit of said mould, said channels being supplied by supply pipes arranged along the vertical direction (A), further comprising at least one connecting pipe suitable to allow to connect a supply pipe, said at least one connecting pipe having a T shape and comprising a first duct rigidly connected to the movable assembly in a horizontal direction (B), as well as a second and a third duct extending from said first duct in opposite ways along the vertical direction (A), said second and third ducts being respectively connected to first and second end portions of the fixed assembly through further axially deformable ducts and being respectively a blind duct and a flow-through duct suitable to allow the cooling fluid to flow towards the first and the second ducts, wherein the second and third ducts of the at least one connecting pipe of said supporting and oscillating device have the same diameter as the supply pipes.

2. A supporting and oscillating device according to claim 1, wherein said further axially deformable ducts are sleeves having an omega-shaped longitudinal section and are made of an elastic material.

3. A supporting and oscillating device according to claim 1, comprising two connecting pipes suitable to allow to connect supply pipes for the cooling fluid to the movable assembly and wherein said two connecting pipes are restrained to the movable assembly symmetrically on opposite sides thereof in the horizontal direction (B).

4. A supporting and oscillating device according to claim 1, further comprising at least one hydro-pneumatic accumulator arranged along the channels formed within the movable assembly.

5. A supporting and oscillating device according to claim 1, wherein the movable assembly of each support comprises channels having a larger diameter suitable to supply cooling fluid to and from the portions of the cooling circuit of the continuous casting mould intended to cool the larger sides of a slab, and channels having a smaller diameter suitable to supply cooling fluid to and from the portions of the cooling circuit intended to cool the smaller sides of said slab, as well as to cool the slab in the first portion of the roll assembly arranged downstream of the continuous casting mould, and wherein the connecting pipes are only connected to the channels having a larger diameter.

6. A supporting and oscillating device according to claim 5, wherein the channels having a larger diameter form a right angle path within the movable assembly between a first opening formed on the lateral surface of the movable assembly and a second aperture formed on its top surface.

7. A supporting and oscillating device according to claim 6, wherein the connecting pipes are connected to the movable assembly at said first apertures of the channels having a larger diameter.

8. A supporting and oscillating device according to claim 1, wherein the movable assembly is slidably restrained to the fixed assembly in the vertical direction (A) by means of a plurality of cantilever springs.

9. A supporting and oscillating device according to claim 1, wherein the first duct of the at least one connecting pipe has the same diameter as the supply pipes.

10. A continuous casting plant comprising a supporting and oscillating device for continuous casting moulds according to claim 1.

* * * * *